US006259207B1

(12) United States Patent
Kirshner

(10) Patent No.: US 6,259,207 B1
(45) **Date of Patent: *Jul. 10, 2001**

(54) WAVEGUIDE SERIES RESONANT CAVITY FOR ENHANCING EFFICIENCY AND BANDWIDTH IN A KLYSTRON

(75) Inventor: Mark Frederick Kirshner, Redwood City, CA (US)

(73) Assignee: Litton Systems, Inc., Woodland Hills, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/123,378

(22) Filed: Jul. 27, 1998

(51) Int. Cl.[7] ..... H01J 23/40
(52) U.S. Cl. ..... 315/39; 315/5.39
(58) Field of Search ..... 315/5.39, 39; 333/211

(56) References Cited

U.S. PATENT DOCUMENTS 2,408,055 * 9/1946 Fiske ..... 315/39 X
2,815,467 12/1957 Gardner ..... 315/5.53

(List continued on next page.)

FOREIGN PATENT DOCUMENTS 0 008 896 * 3/1980 (EP) .
1004976 9/1965 (GB) .
1199341 7/1970 (GB) .
2 098 390 11/1982 (GB) .
10125245 * 5/1998 (JP) .
2005321 12/1993 (RU) ..... 315/5.39

OTHER PUBLICATIONS

Build Absorptive All–Harmonic Waveguide Filters By Richard Z. Gerlack, Design Feature, Microwave & RF, Apr. 1993.

A Wide–Band Inductive–Output Amplifier By Haeff et al., Proceedings of the I.R.E., Mar. 1940, pp. 126–130.

*Primary Examiner*—Benny T. Lee
(74) *Attorney, Agent, or Firm*—O'Melveny & Myers LLP

(57) ABSTRACT

A resonant cavity is coupled in series with an output waveguide of a klystron in order to enhance power within an operating band of the klystron. The response characteristic of the resonant cavity enhances the power at certain frequencies within the operating band of the klystron, e.g., at the high or low ends of the operating band, by intentionally creating a power mismatch at these certain frequencies while providing minimal effect on the power at other frequencies of the band. The resonant cavity is inductively coupled to the output waveguide through an iris that sets the phase of the reflection by virtue of its location in relation to the klystron output gap and the magnitude of the reflection by virtue of its size. A tuning apparatus may also be used for tuning the resonant frequency of the resonant cavities. Plural resonant cavities may also be utilized to provide power mismatches at plural portions of the klystron operating band.

24 Claims, 7 Drawing Sheets

U.S. PATENT DOCUMENTS

| | | | |
|---|---|---|---|
| 2,944,183 | 7/1960 | Drexler | 315/5.46 |
| 2,970,242 | 1/1961 | Jepsen | 315/5.39 |
| 3,016,501 | 1/1962 | Gardner et al. | 315/5.21 |
| 3,028,519 | 4/1962 | Jepsen et al. | 315/5.48 X |
| 3,045,146 | 7/1962 | Haegele et al. | 315/5.21 |
| 3,093,804 | 6/1963 | Larue . | |
| 3,142,028 | 7/1964 | Wanselow | 333/211 |
| 3,305,799 | 2/1967 | Levin | 315/5.39 |
| 3,353,123 * | 11/1967 | Met | 333/211 |
| 3,381,163 | 4/1968 | La Rue et al. | 315/5.39 |
| 3,453,483 | 7/1969 | Leidigh | 315/5.39 |
| 3,484,861 | 12/1969 | Dehn | 315/5.16 |
| 3,529,204 | 9/1970 | Van Iperen et al. | 315/5.39 |
| 3,720,889 | 3/1973 | Gale | 315/5.53 |
| 4,188,600 | 2/1980 | Cavalieri D'Oro | 333/228 |
| 4,284,922 | 8/1981 | Perring et al. | 315/5.39 |
| 4,480,210 | 10/1984 | Preist et al. | 315/4 |
| 4,611,149 | 9/1986 | Nelson | 315/5.39 |
| 4,733,192 | 3/1988 | Heppinstall et al. | 330/45 |
| 4,851,788 | 7/1989 | Ives et al. | 331/91 |
| 4,931,695 | 6/1990 | Symons | 315/5.39 |
| 5,304,942 | 4/1994 | Symons et al. | 330/45 |
| 5,469,022 | 11/1995 | Begum et al. | 315/5.39 |
| 5,469,023 | 11/1995 | Kirshner | 315/5.39 |
| 5,469,024 | 11/1995 | Kirshner et al. | 315/5.39 |
| 5,504,393 | 4/1996 | Kirshner | 315/5.46 |
| 5,650,751 | 7/1997 | Symons | 330/45 |

* cited by examiner

WAVEGUIDE SERIES RESONANT CAVITY FOR ENHANCING EFFICIENCY AND BANDWIDTH IN A KLYSTRON

GOVERNMENT LICENSE RIGHTS

The U.S. Government has a paid-up license in this invention and the right in limited circumstances to require the patent owner to license others on reasonable terms as provided for by the terms of Contract No. F33615-96-D-5101, General Research Corp. Sub-Contract No. 1909-97-02.

BACKGROUND OF THE INVENTION

1. Field of the Invention

The present invention relates to waveguide matching networks for extracting electromagnetic energy from a microwave amplification device, and more particularly, to a resonant cavity in series with the output waveguide for enhancing efficiency and bandwidth in klystrons.

2. Description of Related Art

Linear beam tubes such as klystrons and travelling wave tubes are used in sophisticated communication and radar systems which require amplification of an RF or microwave electromagnetic signal. A klystron comprises a number of cavities divided into essentially three sections: an input section, a buncher section, and an output section. An electron beam is sent through the klystron and the electrons are velocity modulated. Those electrons that have had their velocity increased gradually overtake the slower electrons, resulting in electron bunching. The buncher section amplifies the velocity modulation of the electron beam. The traveling electron bunches represent an RF current in the electron beam. The RF current induces electromagnetic energy into the output section of the klystron as the bunched beam passes through the output cavity, and the electromagnetic energy is extracted from the klystron at the output section. An output waveguide channels the electromagnetic energy to an output device, such as an antenna.

The power produced by a klystron is a function of the level of resistance that is generated across the output gap. The integral of the resistance over angular frequency cannot exceed $\pi/2C$, where C is the input capacity. In the case of a klystron, C is primarily the capacitance of the output gap. If the current produced by the electron beam were independent of gap voltage, then the resistance bandwidth product would approach a theoretical limit defined by Bode's theorem, that is, the integral of $Rd\omega$ cannot exceed $\pi/2C$, where R is the resistance and $d\omega$ is the bandwidth. A detailed description of Bode's theorem is described in his book "Network Analysis and Feedback Amplifier Design," Van Nostrand Company, Inc. 1945 at page 282. In fact, however, the driving current is reduced substantially as the RF voltage developed at the gap begins to exceed the beam voltage. This effect is most pronounced at the band edges where the input impedance of the network has a substantial reactive component. To improve the response, an additional cavity can be coupled to the output. This tends to "square up" the resistance versus frequency characteristic of the gap while minimizing the reactance at the center of the pass-band. Determining the effects of load impedance on output power can lead to further enhancements if an output circuit can be synthesized with the proper voltage standing wave ratio ("VSWR") and phase to maximize power as a function of frequency.

The bandwidth of a klystron can be increased over that produced by a single gap by utilizing output gaps in several cavities coupled together. Energy is extracted from the electron beam in N gaps where 1/N times the total impedance appears at the first gap, and the sum of the voltages at the first gap and succeeding gaps is made roughly equal to the beam voltage by suitable impedance tapering. Bode's theorem again defines the maximal attainable power-bandwidth product, but because the resistive component at the input to the network is lower, one can achieve approximately N times the bandwidth of the single cavity output given similar gap dimensions. As before, based on experimental measurements, power improvements can be realized by the addition of an output network designed to present the optimum phase and VSWR to an output circuit consisting of multiple coupled cavities, each with gaps driven by the electron beam. FIGS. 1 and 2 show the equivalent circuit models for both single and multiple cavity output sections coupled to a terminated waveguide.

Creating a load network that reflects the optimal VSWR and phase found to enhance power across the band is generally a formidable task. In the prior art, most such networks, i.e., waveguide matching networks for broadband klystrons, have utilized shunt susceptances at various distances from the final cavity iris. For example, objects extending part way across the narrow dimension of a $TE_{10}$ waveguide produce shunt capacitive susceptances, and objects running completely across the narrow dimension of a $TE_{10}$ waveguide produce inductive susceptances. However, there are significant drawbacks to utilizing shunt susceptances for impedance matching. For some devices, the ideal transformer ratio should be higher at the band edges to compensate for the increase in the reactive component of the impedance that occurs away from the center of the pass-band. Furthermore, the position of the shunt element combined with the dispersive characteristic of a waveguide creates a situation where the phase of the impedance generated at the output gap is only optimal over a narrow frequency range. As a result, any performance improvement over one portion of the band can be offset by a corresponding degradation elsewhere (i.e., where the reflected impedance is out of phase). In many cases, it is simply not possible to build a transformer consisting of shunt susceptive discontinuities which optimize the output power of either single or multiple gap klystrons over the desired band of operation.

Accordingly, it would be desirable to provide a system that optimizes the output power of a klystron over the desired band of operation. Such a system would be frequency sensitive and could localize over a frequency range the magnitude of the reflection generated, where the magnitude of the reflection generated positively effects output power. Such a system also would allow for an increase in power over a certain frequency range, and also, because of the decrease in the magnitude of the mismatch outside of this frequency range, reduce negative effects on power caused by out of phase reflections. The system would thus produce higher operating power at designated frequencies and simultaneously increase the bandwidth of the klystron.

SUMMARY OF THE INVENTION

In accordance with the teachings of this invention, a system and method are provided for creating a load network for use in a linear beam tube, such as a klystron, that produces the optimal phase and VSWR to enhance power and operating frequency band. More precisely, a system and method are provided that enhance the power over a narrow frequency range and minimize corresponding degradation elsewhere in the operating frequency band.

An embodiment of the system comprises an output waveguide coupled to the output gap of a klystron, one or more resonant cavities disposed along the output waveguide, and a tuning apparatus for use in each resonant cavity. The klystron passes an electron beam through a series of resonant cavities thus producing a bunched electron beam with an RF signal superimposed thereon. An output signal of the klystron is produced at the output gap, which passes through the output waveguide.

The resonant cavity is inductively coupled to the output waveguide through an iris, which sets the phase of the reflection by virtue of its location in relation to the output gap. The resonant cavity is tuned to resonate in or near the klystron operating frequency band. The response characteristic of the resonant cavity enhances the power at certain frequencies within the band, e.g., at the high and low ends, by creating an impedance mismatch. There is minimal effect on the power at other frequencies within the band. An adjustable tuning diaphragm may also be provided for tuning the resonant frequency of the resonant cavity, thereby altering both the magnitude and phase of the reflection.

The method comprises the step of disposing one or more resonant cavities along an output waveguide that is coupled to the output section of a klystron. The method further comprises the steps of selecting the resonance of the one or more resonant cavities at frequencies in or near the klystron frequency operating band, and disposing the resonant cavities at a distance from the klystron output gap sufficient to cause the desired phase of the reflection.

A more complete understanding of the resonant cavity for use in a klystron will be afforded to those skilled in the art, as well as a realization of additional advantages and objects thereof, by consideration of the following detailed description of the preferred embodiment. Reference will be made to the appended sheets of drawings which first will be described briefly.

DETAILED DESCRIPTION OF THE PREFERRED EMBODIMENT

The present invention provides an apparatus and method for providing enhanced efficiency and bandwidth of the klystron by coupling a resonant cavity to an output waveguide of the klystron which intentionally produces an impedance mismatch within the operable band of the klystron. The magnitude and phase of the impedance mismatch is selected to positively affect the output power of the klystron within the operable band. In the detailed description that follows, like element numerals are used to describe like elements illustrated in one or more of the figures.

Figure 1:
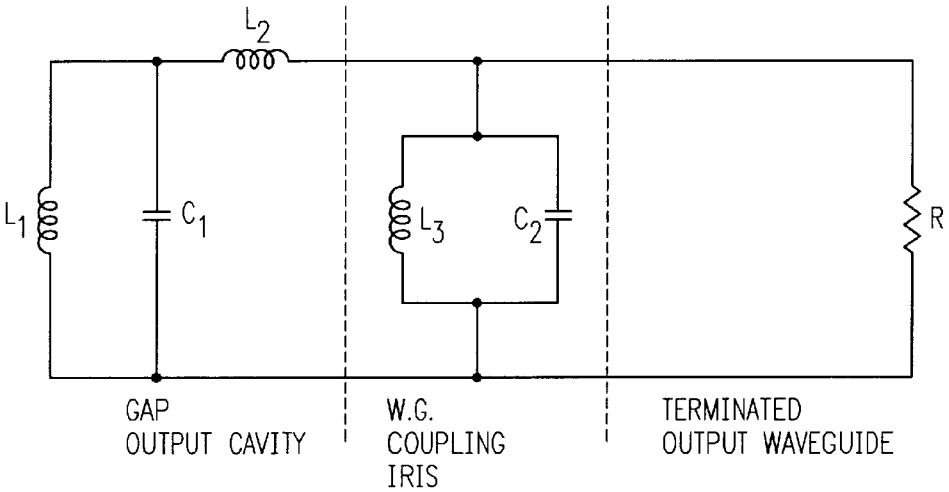
FIG. 1 PRIOR ART
FIG. 1 illustrates an electrical schematic of a conventional single cavity output klystron coupled to a terminated output waveguide.

Referring first to FIG. 1, an equivalent electrical circuit for a klystron is illustrated. The klystron includes an output cavity, a waveguide coupling iris that couples the output cavity to an output waveguide, and the output waveguide. The output cavity, with its corresponding interaction gap, is represented by a cavity capacitance C1 which is almost entirely provided by the capacitance of the gap. A first portion of the cavity inductance L1 is provided in parallel with the cavity capacitance C1, and a second portion of the cavity inductance L2 couples the cavity capacitance C1 to the waveguide coupling iris. The waveguide coupling iris is represented by a parallel LC circuit that includes an iris inductance L3 and shunt capacitance C2 provided across the iris. The resistance R represents the load of the output waveguide properly terminated in its characteristic impedance.

Figure 2:
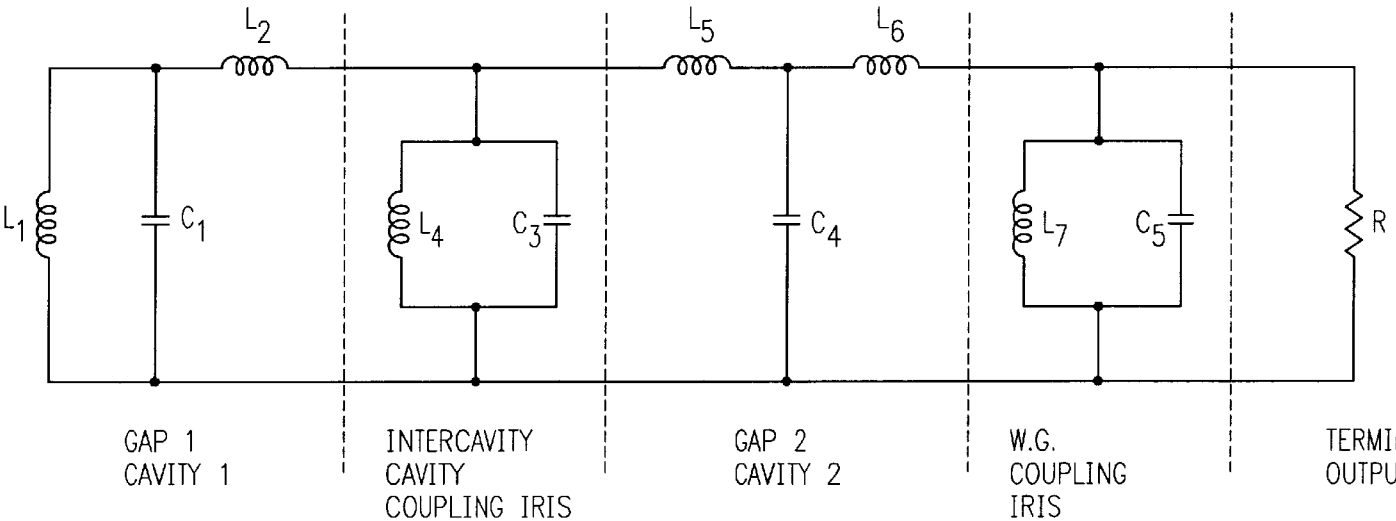
FIG. 2 PRIOR ART
FIG. 2 illustrates a conventional electrical schematic of a two cavity output klystron coupled to a terminated output waveguide.

Similarly, FIG. 2 illustrates an electrical equivalent circuit for an extended interaction output circuit ("EIOC") having two cavities. The EIOC includes a first (Cavity 1), an intercavity coupling iris, a second (Cavity 2), a waveguide coupling iris, and an output waveguide. As in the equivalent electrical circuit of a klystron output cavity discussed above, the first cavity, with its corresponding interaction gap (gap 1), is represented by a cavity capacitance C1, and first and second portions of cavity inductance L1, L2, respectively. The intercavity coupling iris is represented by a coupling inductance L4 and shunt capacitance C3 disposed in parallel. The second cavity, with its corresponding interaction gap (gap 2), is represented by a cavity capacitance C4, and a first portion of cavity inductance L5 and a second portion of cavity inductance L6. Gap 1 and Gap 2 are the interaction gaps of the electron beam with the fields of the respective cavities. The waveguide coupling iris is similar to that of the klystron discussed above, represented by an iris inductance L7, and a shunt capacitance C5. As above, the resistance R represents the load of the output waveguide properly terminated in its characteristic impedance.

In general, the coupling between the output cavity and the output waveguide for both the single cavity output klystron and EIOC is a function of the resonant frequency of the waveguide coupling iris. Tuning the resonant frequency of the iris toward the operating band increases the coupling, resulting in a lower external Q. Conversely, tuning the resonant frequency of the iris away from the operating band decreases the coupling, resulting in a higher external Q. The conventional method for lowering the external Q is to alter the iris inductance by changing the width of the coupling iris, since the iris resonant frequency is inversely proportional to the square root of LC.

Figure 3:
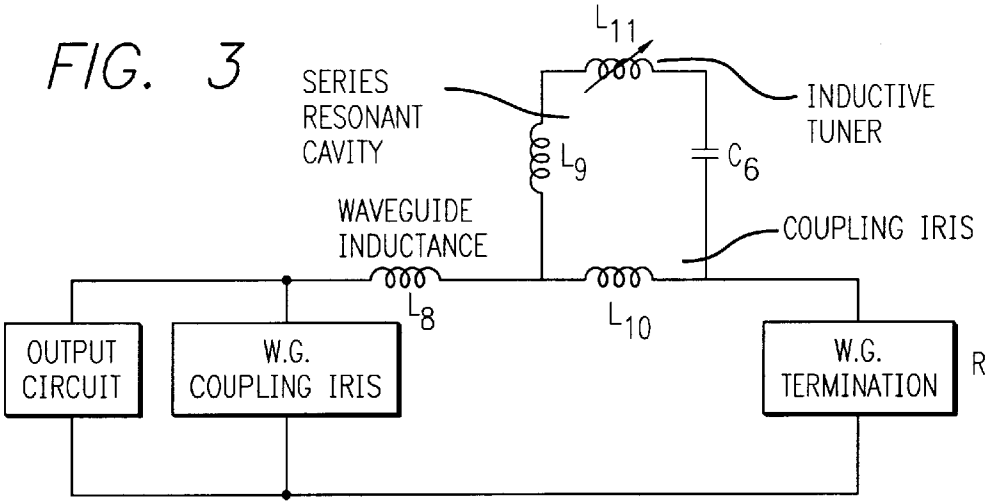
FIG. 3 illustrates an electrical schematic of an output waveguide of a klystron with a resonant cavity of the present invention.

FIG. 3 illustrates an electrical schematic of an output waveguide of a klystron having a resonant cavity coupled to the waveguide in accordance with the teachings of the present invention. Similar to the descriptions of FIGS. 1 and 2, the klystron includes an output circuit representing either the first output cavity of FIG. 1 or the extended interaction cavity of FIG. 2, and a waveguide coupling iris. Also similar to FIGS. 1 and 2, the waveguide coupling iris represents an iris inductance and a shunt capacitance. The schematic of FIG. 3 also shows a waveguide inductance represented by inductance L8. The series resonant cavity of the present invention is represented by an inductance L9, an inductive tuner L11, a capacitance C6 and an inductive coupling iris L10. Again, as above, the resistance R represents the load of the output waveguide properly terminated in its characteristic impedance.

Figure 4:
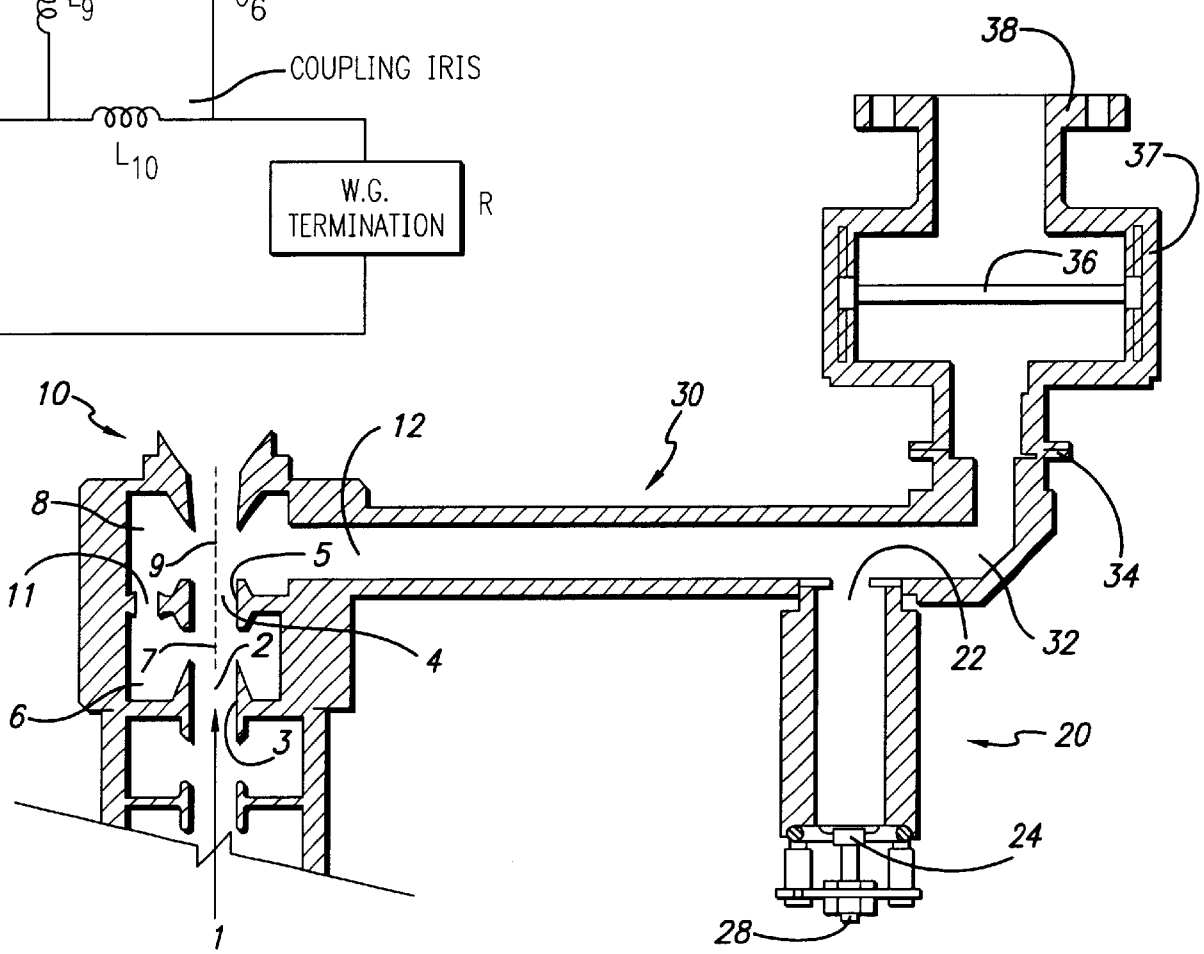
FIG. 4 is a sectional side view of the resonant cavity of the present invention disposed along an output waveguide of a klystron.

FIG. 4 illustrates an output circuit of a klystron 10 having an output waveguide and a resonant cavity 20 in accordance with the teaching of the present invention. The klystron 10 comprises drift tube sections 2 and 4 defined by ferrules 3. Cavities 6 and 8 correspond to the first and second cavities discussed above with respect to FIG. 2. An electron gun (not shown) is disposed at an end of the drift tube section 2 and projects a beam of electrons 1 through the drift tube section 2.

The modulated bunched electron beam 1 is received by the output circuit through the drift tube section 2 and a gap 7 of the first cavity 6 of the output circuit. The beam 1 then passes through a second drift tube section 4 defined by ferrules 5, and a gap 9 of the second cavity 8 of the output circuit. The gap 9 provides a final output gap for the klystron. The spent electrons of the beam 1 exit the drift tube section 4 and are collected within a collector (not shown) at an opposite end of the first drift tube section 2. The bunched electron beam 1 excites the first cavity 6 and creates an electromagnetic field that produces an RF electromagnetic wave which propagates through the intercavity coupling iris 11 into the second cavity 8. Similarly, as the modulated electron beam 1 passes across the gap 9 of the second cavity 8, the modulated electron beam 1 further reinforces the RF electromagnetic wave.

The RF energy produced within the klystron is removed from the drift tube section 4 through a coupling iris 12 to an output waveguide 30 that couples the RF energy out of the klystron. As known in the art, the output waveguide 30 serves as an output transmission line for the amplified RF energy that enables the coupling of the amplified RF energy into an output device, such as an antenna, rotary joint, or other such device. The output waveguide 30 includes a flange 38 at a distal end thereof that permits the mechanical coupling of the output waveguide to an output device or to another transmission line.

Figure 5:
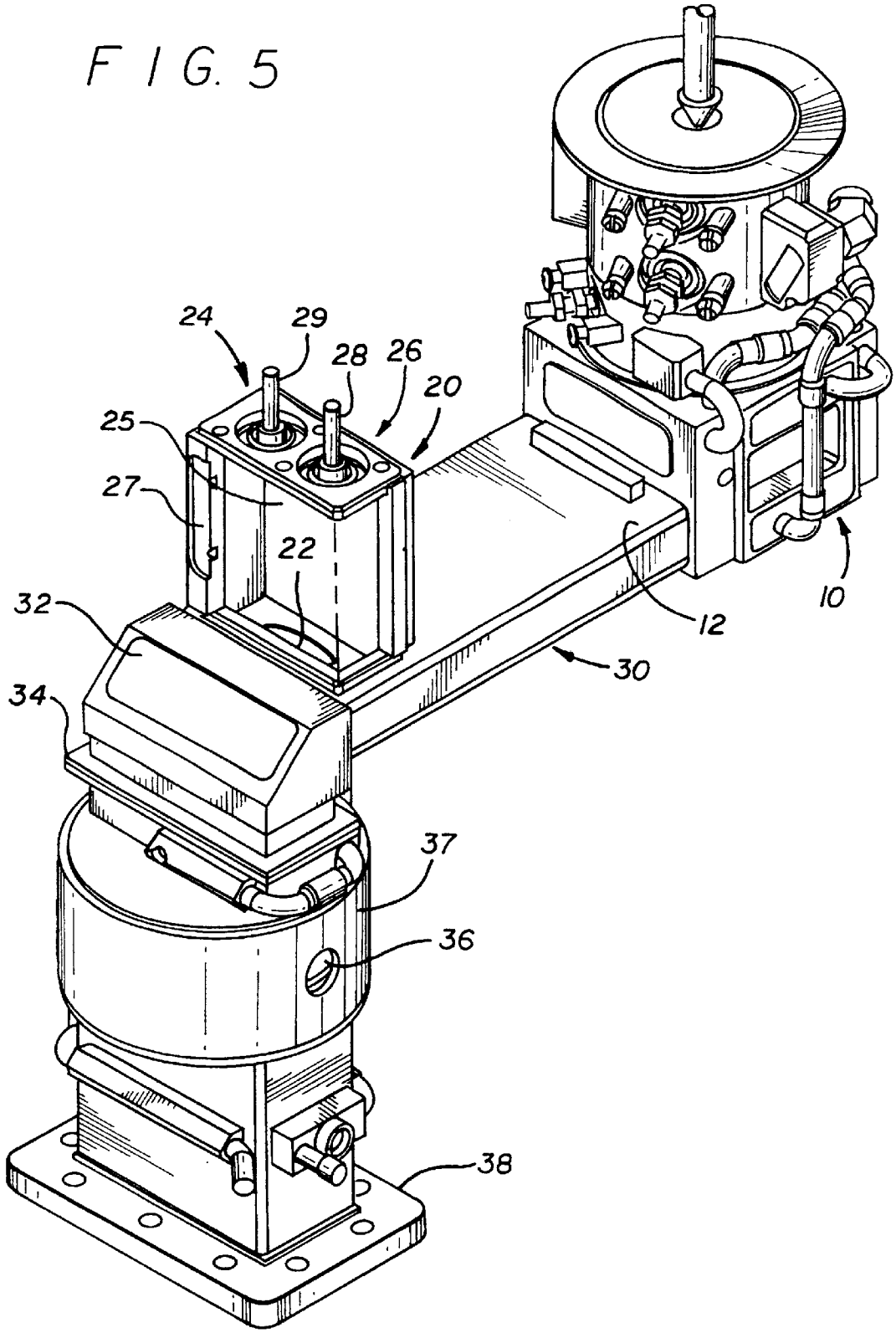
FIG. 5 is a perspective view of the resonant cavity disposed along an output waveguide which is coupled at one end to an output section of the klystron.

As illustrated in FIGS. 4 and 5, the output waveguide 30 further includes a miter bend 32 that allows the RF energy of the klystron 10 to be directed in an orientation parallel to a central axis of the klystron. Moreover, the output waveguide also includes an RF transparent window 36 that provides a vacuum seal for the klystron 10 and output waveguide 30. The window 36 is provided in a generally circular housing 37 that is coupled to the miter bend 32 at a braze joint 34. The housing 37 also provides the flange 38 at an end thereof opposite of the window from the klystron 10. It should be appreciated that the miter bend 32 and RF transparent window 36 otherwise have no affect on the performance of the output waveguide 30 or on the invention discussed herein, are described merely to clarify the operational environment of the preferred embodiment. While the output waveguide 30 and the flange 38 have a rectangular shape intended to match uniformly with other waveguide sections or transmission lines that are coupled thereto so as to avoid any unintended perturbations or reflections of the propagating RF power, it should also be appreciated that other shapes, such as round, could also be advantageously utilized.

FIGS. 4 and 5 also shows a resonant cavity 20 coupled to the output waveguide 30. The resonant cavity 20 is disposed a predetermined distance from the coupling iris 12 of the klystron 10. Referring now to FIG. 5, a description of the resonant cavity 20 and the method for creating a load network for use in the klystron 10 are provided in greater detail. The resonant cavity 20 is disposed along the output waveguide 30, and comprises a coupling iris 22 (see also FIG. 4) that couples RF energy between the output waveguide 30 and the resonant cavity 20. Although the coupling iris 22 can be any shape from a large round opening to a narrow slit, optimum performance is achieved when the coupling iris 22 is elliptical in shape due to the high voltage standoff capability of such a configuration. The resonant cavity 20 is secured to the waveguide 30 by conventional joining techniques, such as high temperature brazing or welding. As illustrated in FIG. 5, the resonant cavity 20 has a rectangular shape, though other shapes can also be advantageously utilized.

The resonant cavity 20 has a resonant frequency determined by the dimensions of its internal surfaces 25, e.g., volume. Attached to the resonant cavity 20 are adjustable tuners for tuning the resonant frequency of the resonant cavity 20. The adjustable tuners comprise diaphragms 24, 26 and tuning posts 28, 29. Diaphragm 24 and tuning post 28 are also shown in FIG. 4. It is anticipated that the diaphragms 24, 26 be comprised of an electrically conductive material, such as copper, and will be approximately 20–25 thousands of an inch thick. The tuners operate by pushing in and pulling out the posts 28, 29 in an axial direction to cause the diaphragms 24, 26 to move in and out, respectively. By moving the diaphragms 24, 26 in and out, the volume of the resonant cavity 20 changes. This tuning method allows for fine adjustments of the phase and magnitude of the response characteristic of the resonant cavity 20. It should be noted, however, that the tuners are not necessary but are desirable for fine tuning of the resonant cavity 20.

It should be appreciated that the resonant frequency of the resonant cavity 20 may fluctuate in response to temperature changes, which, in turn, result in changes in the internal dimensions of the resonant cavity. Accordingly, to maintain the temperature at a near constant temperature, a cooling fluid may be provided in a coolant passage 27 disposed around the sidewalls of the resonant cavity 20.

In the preferred embodiment, in operation, the resonant cavity 20 provides a voltage reflection that peaks outside the operating band of the klystron 10 in a manner to provide the desired amount of power increase at the band edge. Properly constructed, the change in the magnitude of the voltage reflection coefficient with frequency is matched to the demands of the output circuit to create an optimal load characteristic. It should be recognized, however, that an in band reflection might optimize output power characteristics in some cases. The degree to which the magnitude of the mismatch decreases as one moves toward the center of the passband is determined by the amount of inductive coupling to the output waveguide 30, i.e., by the size and shape of the coupling iris 22. In addition, the phase of the mismatch is determined by the distance between the coupling iris 22 and the output gap 9 of the klystron 10 as seen in FIG. 4. The size of the coupling iris 22 is selected based on the desired response curve for the resonant cavity 20. By increasing the size of the coupling iris 22, the Q of the resonant cavity 20 is lowered, causing the frequency response curve of the resonant cavity to be broadened. Conversely, decreasing the size of the coupling iris 22 increases the Q of the resonant cavity 20, which tends to narrow the edges of the frequency response curve. The Q of the resonant cavity 20 may thereby be selected in order to manipulate the shape of its frequency response curve so that it covers a desired portion of the operating band of the klystron 10.

Figure 6:
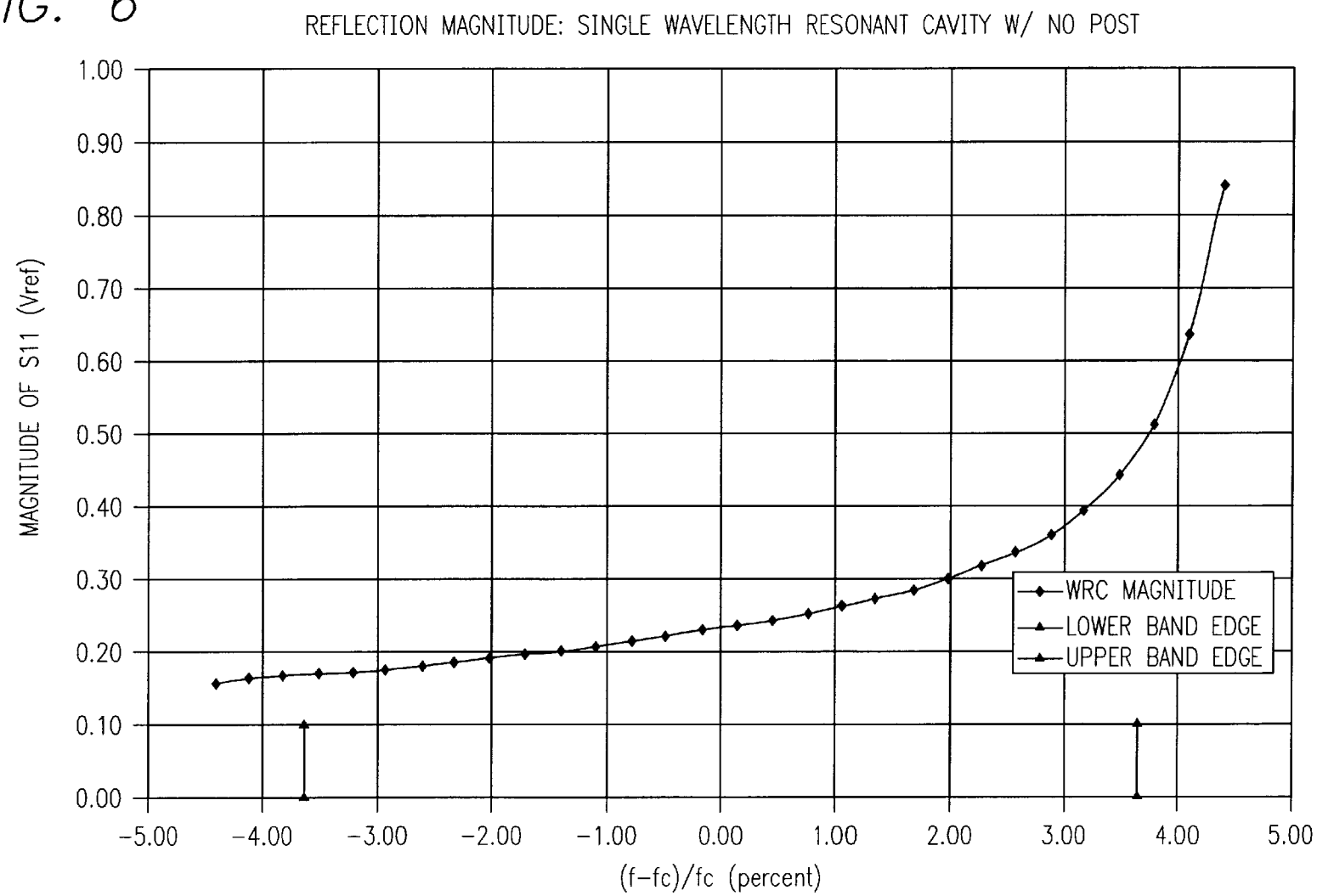
FIG. 6 is a chart showing reflection magnitude versus frequency for a single resonant cavity of the present invention tuned above the operating band.
Figure 7:
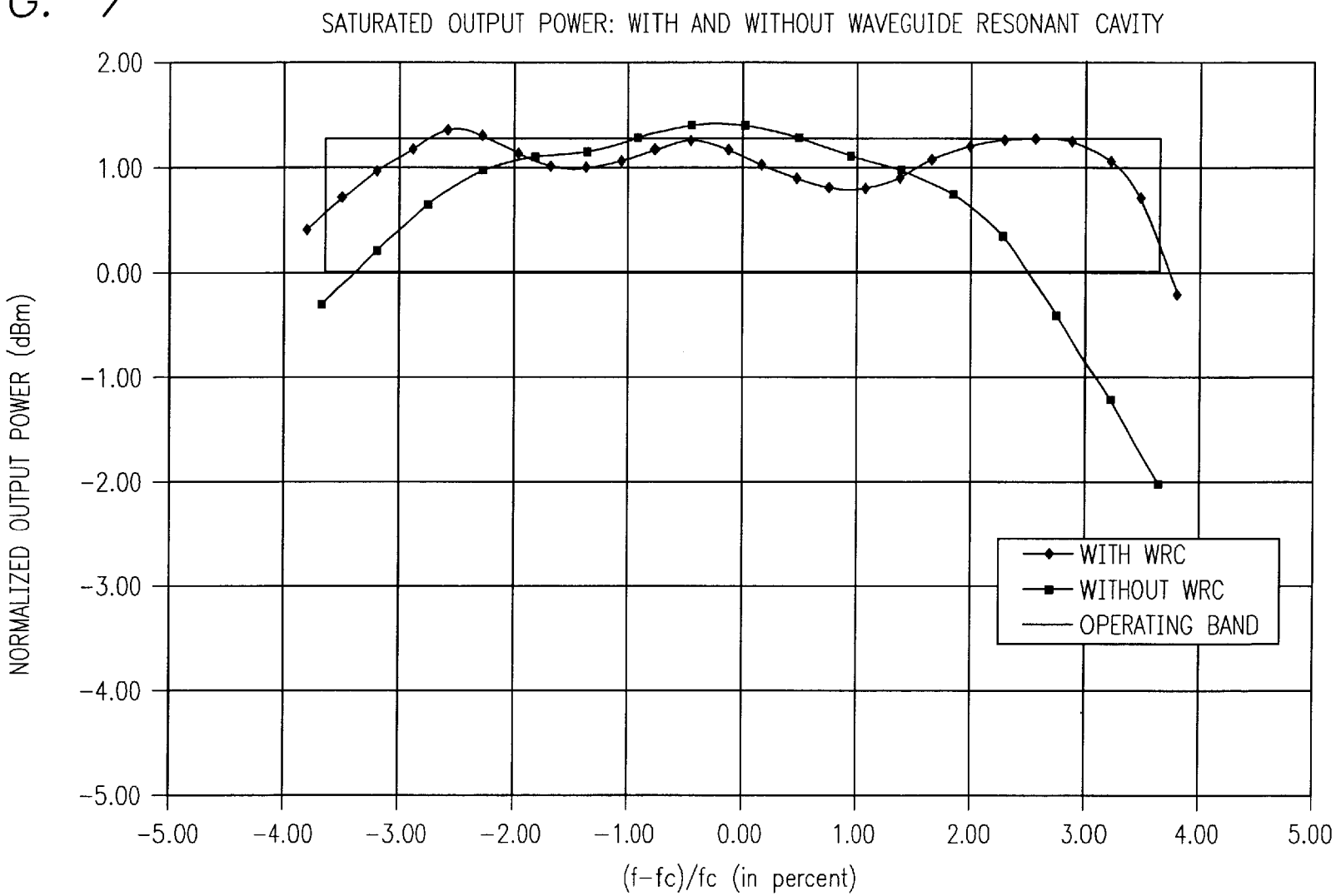
FIG. 7 is a chart comparing a normalized output power versus bandwidth for a klystron output waveguide with and without the single resonant cavity.

FIG. 6 is a chart showing the measured magnitude of the mismatch of the reflected voltage versus frequency, for a klystron having the single resonant cavity tuned above the operating band. Frequency is expressed as a percentage of a center frequency in the form $(f-f_c)/f_c$ wherein f is the actual frequency and $f_c$ is a center frequency of a klystron operating band. A curve (illustrated using diamonds) shows the reflection magnitude of a waveguide resonant cavity (WRC Magnitude) as a function of frequency, and the upper and lower edges of the band (illustrated using triangles). From FIG. 6, it will be apparent that the present system produces a large impedance mismatch that is localized over the frequency at the high end of the frequency operating band of the klystron. The magnitude ($S_{11}$) of the voltage reflection ($V_{ref}$) at the remaining frequencies within the band is minimal. FIG. 7 is a chart showing the saturated output power of a klystron both with and without a single resonant cavity of the present invention (such as the resonant cavity 20 of FIGS. 4 and 5) with respect to frequency. A first curve (illustrated with diamonds) shows operation of the klystron with the resonant cavity, and a second curve (illustrated with rectangles) shows operation of the klystron without the resonant cavity. Frequency is expressed as a percentage of center frequency in the same manner as in FIG. 6. As shown in FIG. 7, with the resonant cavity 20 configured as described above (e.g., see FIG. 5), the power at the high end of the bandwidth is significantly increased over that which would be achieved without the resonant cavity 20. It should be appreciated that the resonant cavity could also be tuned to provide a localized impedance mismatch at the low end of the frequency operating band of the klystron, or at the middle portion of the frequency operating band between the high and low ends.

The above described embodiment illustrates a configuration with one resonant cavity. It should be appreciated, however, that more than one resonant cavity can also be utilized to, for example, increase the power over two distinct frequency ranges, such as the upper and lower band portions (the band edges). Further, one or more shunt susceptances may be used in connection with the resonant cavity or cavities. These shunt susceptances would be coupled to the output waveguide and disposed between the klystron output cavity gap 9 and the waveguide termination coupling 34 at a distance sufficient to further tailor the desired impedance transformation between the output gap and waveguide. The shunt susceptances (either capacitive or inductive) have the effect of keeping the magnitude of the voltage reflection coefficient over the middle of the band lower by offsetting the effects of the resonant cavity 20 in this region.

Figure 8:
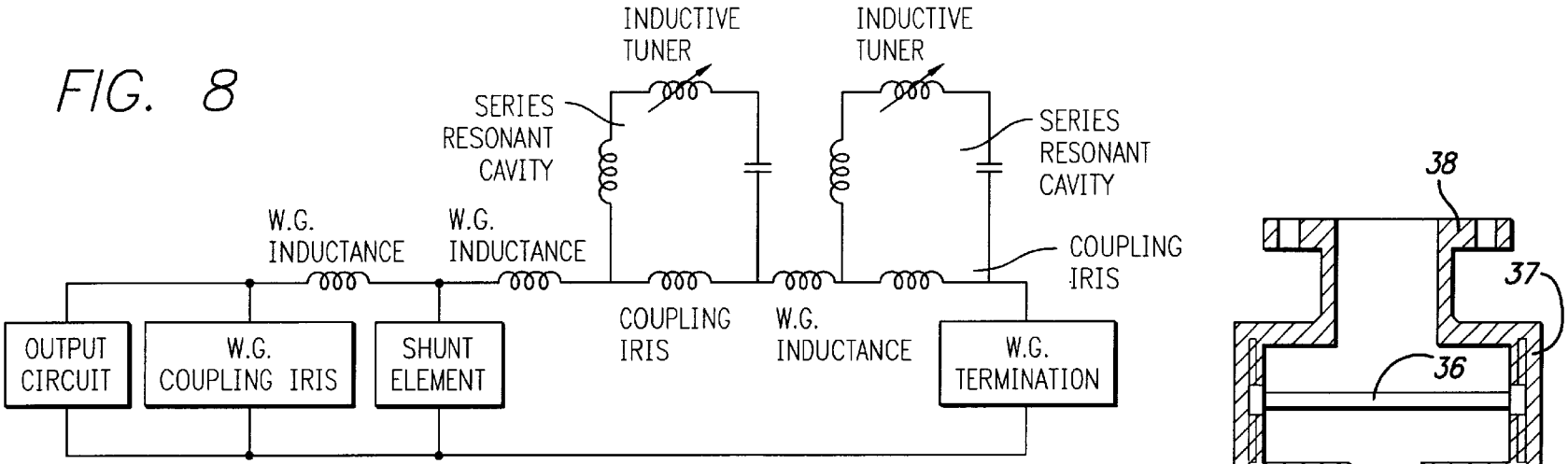
FIG. 8 illustrates an electrical schematic of an output waveguide of a klystron with two resonant cavities of the present invention.
Figure 9:
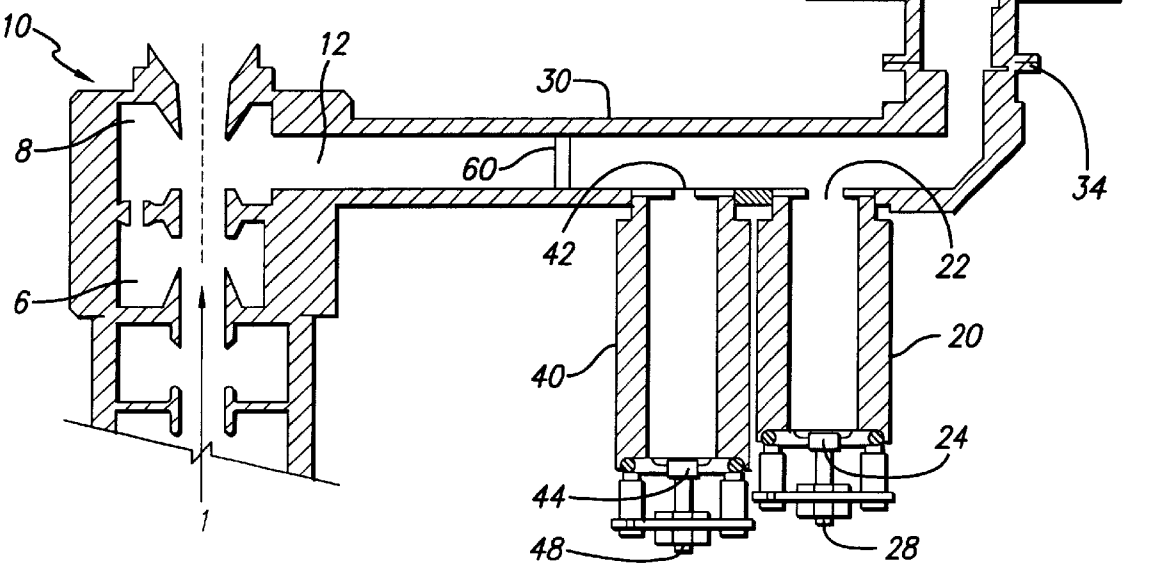
FIG. 9 is a sectional side view of two resonant cavities disposed along an output waveguide of a klystron.
Figure 10:
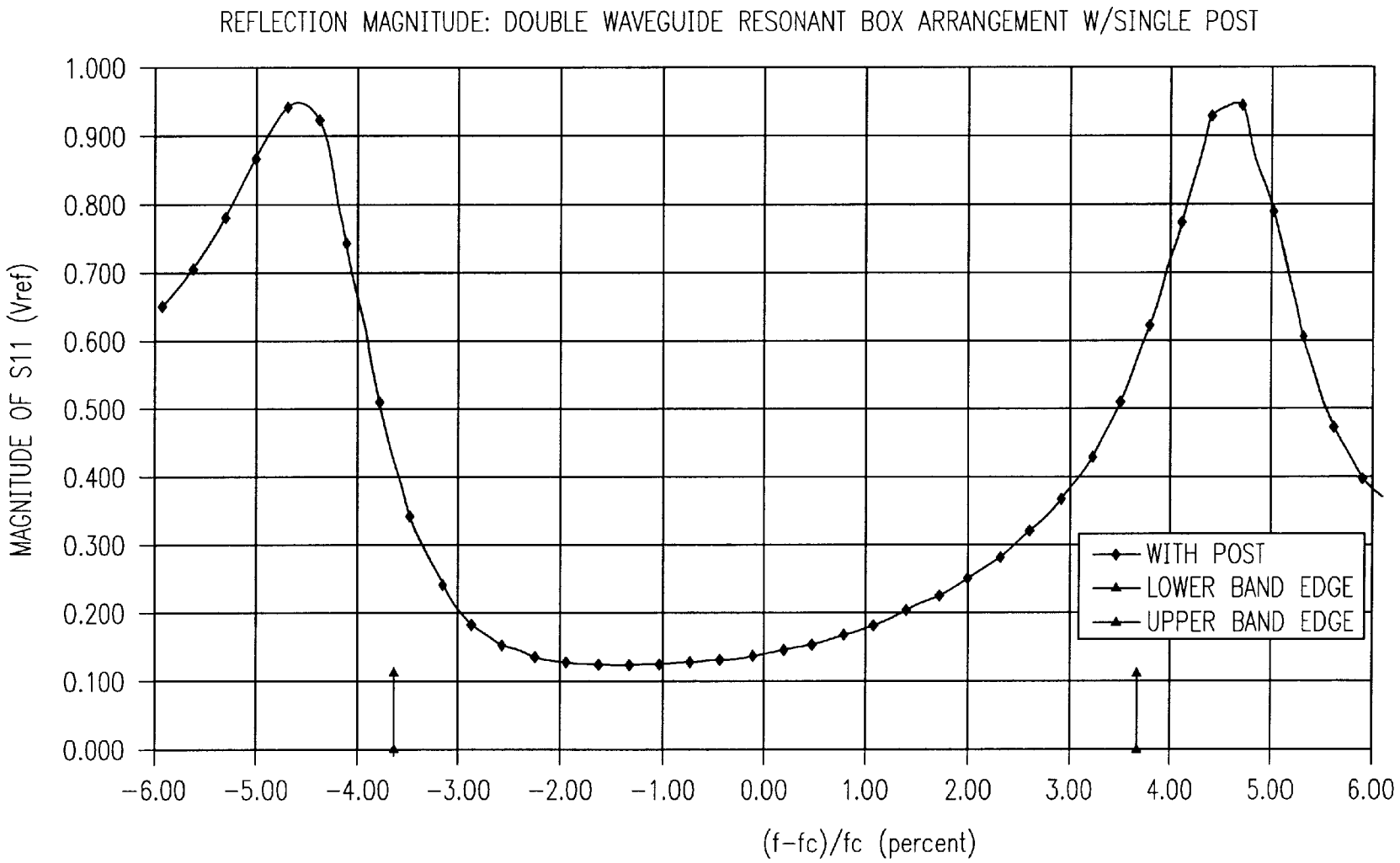
FIG. 10 is a chart showing reflection magnitude versus bandwidth for a double resonant cavity combined with one shunt susceptive element of the present invention.

FIGS. 8 through 10 illustrate this alternative embodiment of the invention. Specifically, FIG. 8 illustrates an electrical schematic of an output waveguide of a klystron with two waveguide resonant cavities of the present invention and a shunt susceptance. The electrical schematic of FIG. 8 is substantially the same as that described above with respect to FIG. 3, except that it includes a second series resonant cavity. Similarly, FIG. 9 illustrates a klystron 10 in the same manner as described above with respect to FIG. 4, except that it includes two resonant cavities 20 and 40 coupled to the output waveguide 30 in accordance with the teaching of the present invention. The second resonant cavity 40 includes a coupling iris 42 and an adjustable tuner having a diaphragm 44 and post 48, which are substantially identical to the resonant cavity 20 discussed above with respect to FIG. 4. Further, a shunt susceptance 60 is disposed adjacent to the coupling iris 12 of the klystron 10. Again, this allows for the design of a network where the magnitude of the reflection generated is localized only over the frequency range where it positively effects output power. The shunt susceptance 60 need not be disposed between the coupling iris 12 and the respective resonant cavities 20, 40, but, rather, may be disposed anywhere along the output waveguide 30 so as to achieve the desired operation. FIG. 9 also illustrates a braze joint 34, an RF transparent window 36 in a circular housing 37, and a flange 38, as described above with respect to FIGS. 4 and 5.

FIG. 10 is a chart showing reflection magnitude $S_{11}(V_{ref})$ versus bandwidth $(f-f_c)/f_c$ for a double resonant cavity combined with one shunt susceptive element of the present invention. The chart shows that the present system can produce a relatively high power output over a broad bandwidth by increasing the magnitude of the voltage reflection at both the high and low ends of the band. Again, the voltage reflection at the remaining frequencies within the bandwidth is minimal for this case; however, the shunt susceptance keeps the magnitude of the voltage reflection at the middle of the band lower than what would otherwise be achieved without the shunt susceptance.

Having thus described a preferred embodiment of the resonant cavity, it should be apparent to those skilled in the art that certain advantages of the foregoing system have been achieved. It should also be appreciated that various modifications, adaptations, and alternative embodiments thereof may be made within the scope and spirit of the present invention. For example, the adjustable tuner disclosed above is an inductive type designed to alter the inductance of the resonant cavity, but the adjustable tuner can alternatively be of a capacitive type. Additionally, although a diaphragm tuner has been illustrated, other types of tuners can be used.

The invention is further defined by the following claims. What is claimed is:

1. In a linear beam tube having an operating frequency band, a load network comprising:

an output waveguide for transmitting an output signal generated by said linear beam tube, said output waveguide having a first respective end coupled to an output section of said linear beam tube and a second respective end adapted for coupling to a load; and at least one resonant cavity electrically coupled with said output waveguide through an inductance whose component of series susceptance is substantially greater than the corresponding component of shunt susceptance, said at least one resonant cavity producing a reflection of power within said output waveguide and having a resonant frequency tuned outside of an edge of said operating frequency band of said linear beam tube, said resonant frequency being of such a value so as to provide an impedance mismatch in certain portions of said operating band.

2. The load network of claim 1, wherein said resonant cavity further comprises a coupling iris, said coupling iris being disposed a predetermined distance from an output cavity gap of said linear beam tube to provide a desired phase of the reflection of power.

3. The load network of claim 2, wherein said coupling iris further comprises a predetermined size to provide a desired magnitude of the reflection of power.

4. The load network of claim 2, wherein said coupling iris further comprises an elliptical shape.

5. The load network of claim 1, wherein said network further comprises means for tuning said resonant frequency of said resonant cavity.

6. The load network of claim 5, wherein said tuning means further comprises an inductive tuner.

7. The load network of claim 1, further comprising means for maintaining thermal stability of said resonant cavity.

8. The load network of claim 1, further comprising at least one shunt susceptive element coupled to said output waveguide.

9. The load network of claim 8, wherein said at least one shunt susceptive element perpendicularly intersects with a wall of said output waveguide and is disposed between said output section and said second end of said output waveguide at a distance of such a value so as to provide a desired phase of the reflection of power.

10. The load network of claim 1, wherein said certain portions of said operating band further comprises an upper portion of said operating band.

11. The load network of claim 1, wherein said certain portions of said operating band further comprises a lower portion of said operating band.

12. The load network of claim 1, wherein said certain portions of said operating band further comprises a middle portion of said operating band.

13. The load network of claim 1, wherein said resonant frequency of said resonant cavity is tuned outside said operating band of said linear beam tube.

14. The load network of claim 1, wherein said resonant frequency of said resonant cavity is tuned within said operating band of said linear beam tube.

15. A method for coupling energy from a kylstron to a load, said klystron having an output cavity gap and said method comprising the steps of:

providing an output waveguide for transmitting an output signal generated by said klystron; and producing a reflection of power within said output waveguide, said reflection having a resonant frequency tuned outside of an edge of an operating frequency band of said klystron, such that an impedance mismatch inside of said operating frequency band is created and wherein the reflection has a magnitude and phase which positively affects output power of the klystron.

16. The method of claim 15, wherein said producing step further comprises coupling at least one resonant cavity to said output waveguide.

17. The method of claim 16, further comprising a step of determining a desired phase of the reflection by disposing a coupling iris of said at least one resonant cavity a predetermined distance from an output cavity gap of said klystron.

18. The method of claim 16, further comprising a step of tuning said resonant frequency of said at least one resonant cavity.

19. The method of claim 16, further comprising a step of maintaining thermal stability of said at least one resonant cavity.

20. The method of claim 16, further comprising a step of determining a desired magnitude of the reflection by selecting a size of a coupling iris of said resonant cavity.

21. The method of claim 15, wherein said step of producing a reflection further comprises producing said reflection only at a lower portion of said operating band.

22. The method of claim 15, wherein said step of producing a reflection further comprises producing said reflection only at a middle portion of said operating band.

23. The method of claim 15, wherein said step of producing a reflection further comprises producing said reflection only at an upper portion of said operating band.

24. The method of claim 15, further comprising a step of coupling at least one shunt susceptive element to said output waveguide.

* * * * *